US005378065A

United States Patent [19]

Tobolka

[11] Patent Number: 5,378,065

[45] Date of Patent: Jan. 3, 1995

[54] CONTAINER

[76] Inventor: Stefan Tobolka, 2146 Olde Base Line Road, Ingelwood, Ontario, Canada

[21] Appl. No.: 175,938

[22] Filed: Dec. 30, 1993

[51] Int. Cl.[6] ..... B65D 30/16; B65D 33/36

[52] U.S. Cl. ..... 383/9; 383/10; 383/104; 383/122; 383/906

[58] Field of Search ..... 383/9, 10, 104, 88, 383/89, 906, 122

[56] References Cited

U.S. PATENT DOCUMENTS

| | | | |
|---|---|---|---|
| 2,554,050 | 5/1951 | Neubeck | 383/906 X |
| 2,950,029 | 8/1960 | Winstead . | |
| 2,999,627 | 9/1961 | Reinhardt | 383/906 X |
| 3,009,498 | 11/1961 | Fohr . | |
| 3,367,380 | 2/1968 | Dickey . | |
| 3,387,701 | 6/1968 | Schneider et al. | 383/104 X |
| 3,502,521 | 3/1970 | Doyen et al. | 383/906 X |
| 4,041,851 | 8/1977 | Jentsch | 383/122 X |
| 4,314,558 | 2/1982 | Korpman . | |
| 4,361,235 | 11/1982 | Gautier | 383/104 X |
| 4,718,778 | 1/1988 | Tchikawa . | |
| 4,911,563 | 3/1990 | Ciani . | |
| 4,974,732 | 12/1990 | Sullivan et al. | 383/908 X |
| 5,018,646 | 5/1991 | Billman et al. | 383/104 X |
| 5,054,631 | 10/1991 | Robbins, III . | |
| 5,228,782 | 7/1993 | Imer | 383/906 X |

FOREIGN PATENT DOCUMENTS

| | | | |
|---|---|---|---|
| 33991 | 12/1964 | Finland . | |
| 5077838 | 3/1993 | Japan | 383/104 |
| 978901 | 1/1965 | United Kingdom . | |
| 9008704 | 8/1990 | WIPO . | |

*Primary Examiner*—Allan N. Shoap
*Assistant Examiner*—Jes F. Pascua
*Attorney, Agent, or Firm*—Bachman & LaPointe

[57] ABSTRACT

A single, unitary piece of plastic folded and bonded together to form a container, including a spout extending upwardly from the shoulder and forming an integral straw, and an opening in the spout to provide access to the container.

9 Claims, 5 Drawing Sheets

CONTAINER

BACKGROUND OF THE INVENTION

The present invention relates to light weight, flexible containers adapted to hold liquids.

It is highly desirable to provide a container as aforesaid, especially one which can be easily prepared which protects the contents from contamination and which is freestanding. It is also desirable to provide such a container which is a single serving container and which includes an integral straw which can be readily used without requiring a valve or the like to remove the contents of the container.

It is particularly desirable to provide such a container which is completely recyclable and which is light weight.

SUMMARY OF THE INVENTION

In accordance with the present invention, the foregoing objectives are readily obtained.

The container of the present invention comprises: a single unitary piece of plastic folded and bonded together to form a container, said container having a base portion, a body portion extending upwardly from the base, a shoulder portion extending upwardly from the body portion, and an integral spout portion extending upwardly from the shoulder and forming an integral straw, bonded portions of said plastic extending upwardly from the base along the body portion, shoulder portion and spout portion, and an opening in the spout portion to provide access to the container.

In a particularly preferred embodiment, the spout portion has an end portion, a length, an opening in the end position and an open channel along the length thereof to provide access to the container, including at least one constricted area in said open channel. The spout portion includes a lower portion thereof adjacent the shoulder portion, with the constricted area preferably being located in said lower portion.

Preferably, the base is flat to provide a self standing container when the container is filled.

The length of the spout is preferably equal to at least one-half of the length of the body portion from the base to the shoulder. Desirably, the spout is folded over alongside of the body portion when the container is not in use.

Further features and advantages of the present invention will appear hereinbelow.

BRIEF DESCRIPTION OF THE DRAWINGS

The present invention will be more readily apparent from a consideration of the following illustrative drawings wherein.

DETAILED DESCRIPTION OF THE PREFERRED EMBODIMENTS

Figure 1:
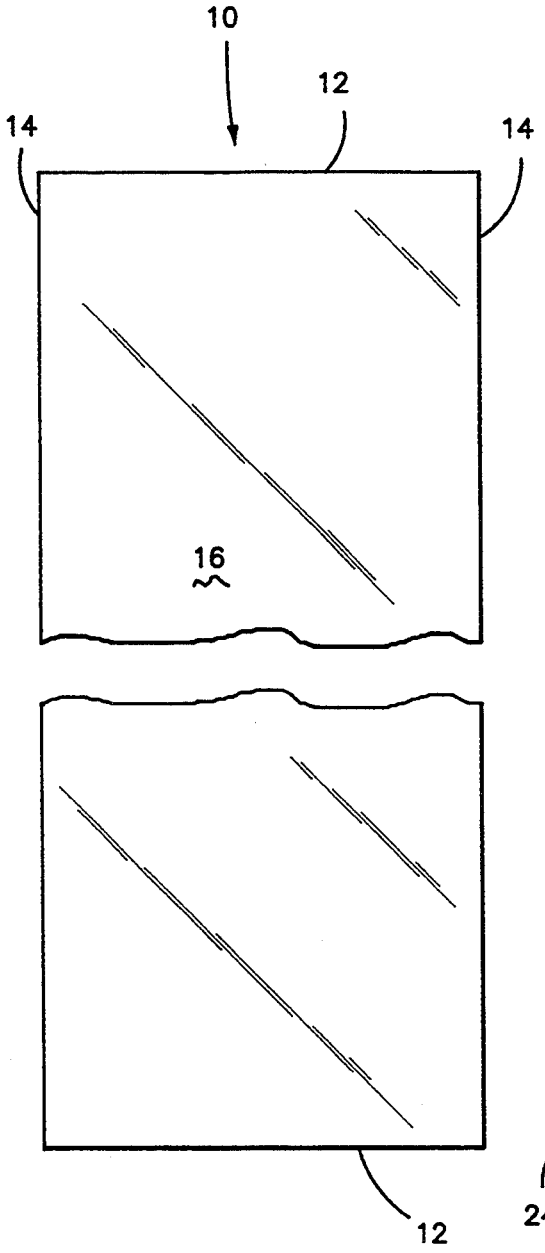
FIG. 1 is a top plan view of a starting sheet material of the present invention.

FIG. 1 is a top plan view of a starting sheet material 10, generally elongated, rectangular in shape preferably including parallel end regions 12, parallel side regions 14, and a central region 16, with the end regions being shorter than the side regions. Any suitable plastic material can be used, such as polyethylene, polypropylene, polyvinyl chloride. Generally, a light weight, flexible plastic film is used which may be a single layer or multilayer, extruded or coextruded. The material should naturally be suitable for contact with food material.

Figure 2:
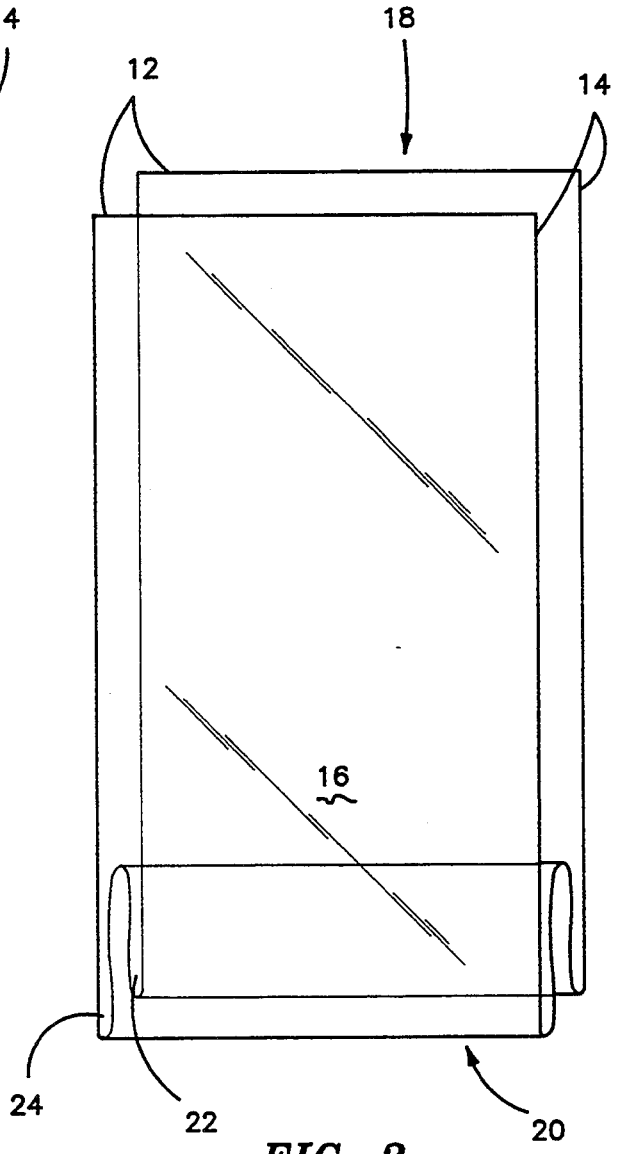
FIG. 2 is a view of the sheet material of FIG. 1 folded over in preparation for bonding to form a container.

In the preparation of the container of the present invention, the elongated sheet material of FIG. 1 is folded as shown in the embodiment of FIG. 2 to form the folded sheet 18 with end and side regions 12 and 14 adjacent one another and with central region 16 folded over on itself to form a folded base 20 which in this embodiment includes first and second folds 22 and 24 intended to form a gussetted base for the container.

Figure 3:
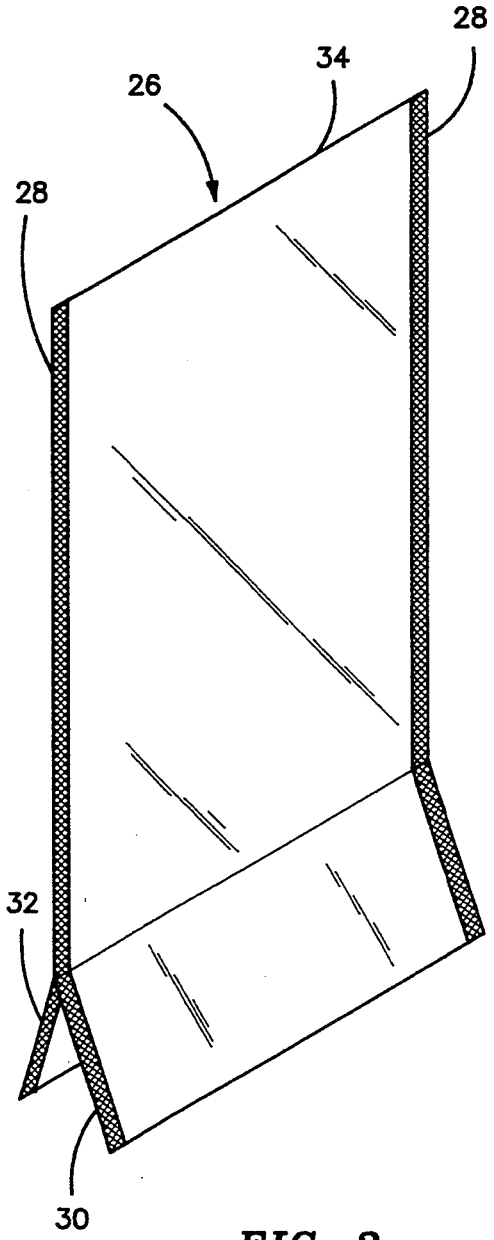
FIG. 3 is a view of the material of FIG. 2 after initial bonding.

The folded sheet 18 of FIG. 2 is now bonded together, as shown in FIG. 3, to form a bonded container blank 26 with side regions 14 bonded together as by heat sealing to form side bonded regions 28 and first and second folds 22 and 24 bonded together as by heat sealing to form bonded base regions 30 and 32. End regions 12 are left unbonded or unsealed to provide the bonded container blank with an open top portion 34.

Figure 4:
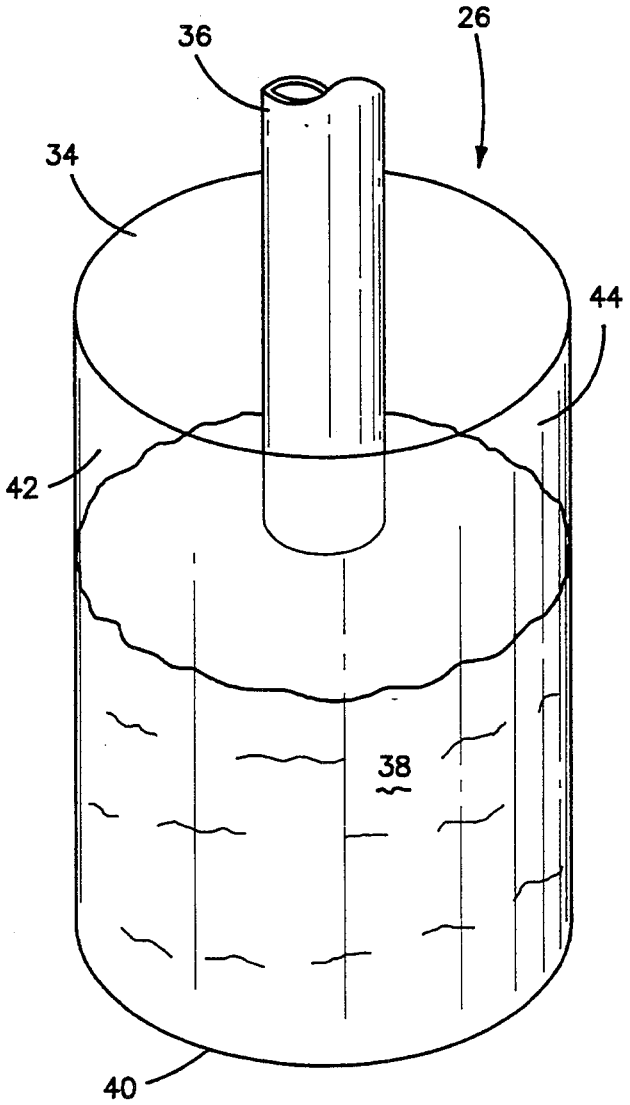
FIG. 4 is a view of the bonded material of FIG. 3 being filled with liquid.

The resultant bonded container blank can then be filled, as shown in FIG. 4, via filling tube 36 with liquid 38 which results in the bonded base regions 30, 32 extending outwardly to form a flat base 40 providing a self standing or self supporting container.

Figure 5:
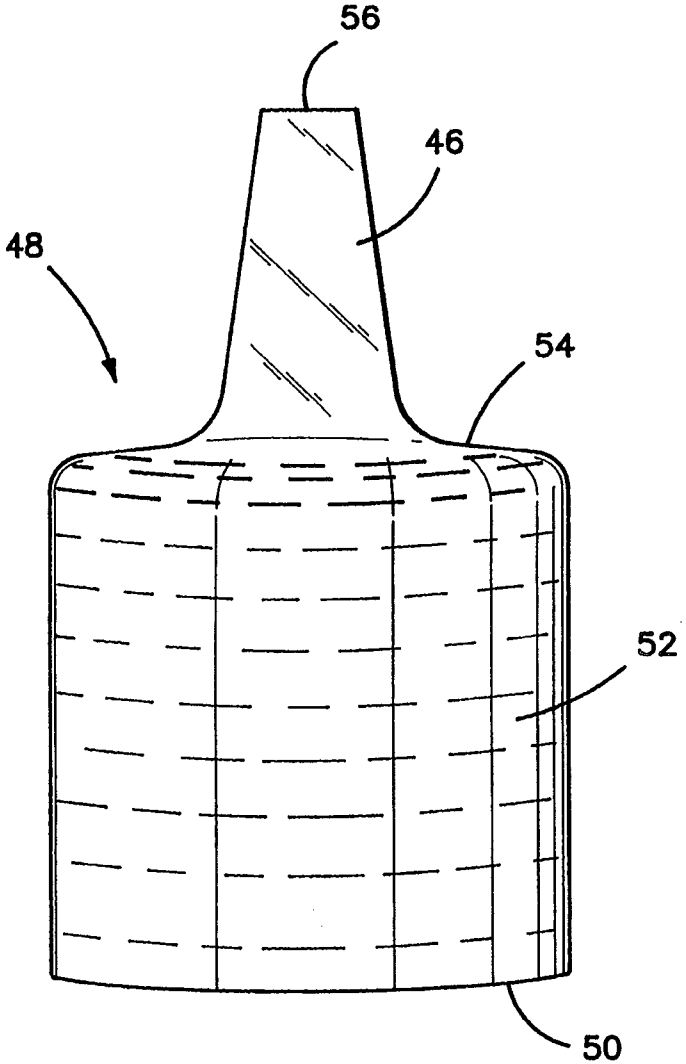
FIG. 5 is a view of the final formation of the container of the present invention from the filled material of FIG. 4.

The resultant container blank 26 filled with liquid 38 can then be formed into a container of the present invention, as shown in FIG. 5, by removing unfilled upper side portions 42 and 44, as by cutting them away, leaving an integral spout portion 46. Thus, container 48 shown in FIG. 5 has a flat base portion 50, a body portion 52 extending upwardly from the base, a shoulder portion 54 extending upwardly from the body portion, and the integral spout 46 extending upwardly from the shoulder centrally of container 48. The peripheral portions of the shoulder and spout are heat sealed as in FIG. 3 to form a closed container 48 open only at the top 56 of spout 46 to provide access into the interior of container 48. Spout 46 thus provides an integral straw providing access to the contents of the container.

If desired, upper side portions 42, 44 can be removed before filling and the container 48 filled via spout 46.

Figure 6:
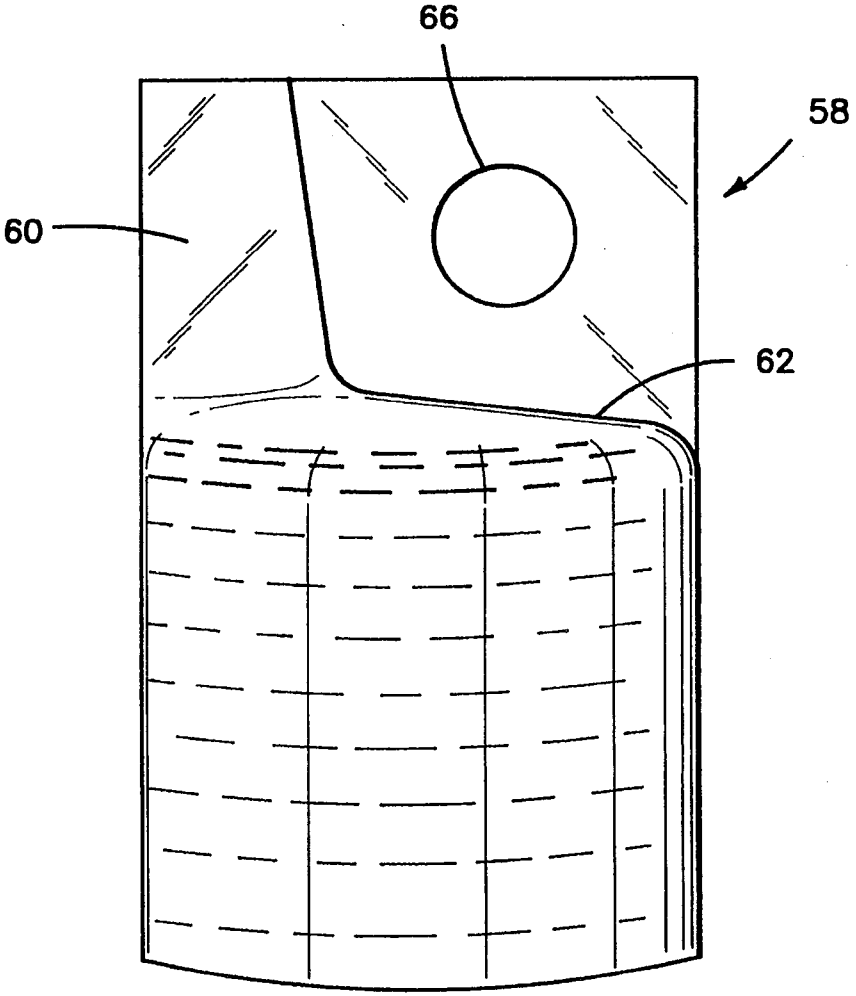
FIG. 6 is a view similar to FIG. 5 of a variant container.

The alternate embodiment of FIG. 6 shows container 58 with peripheral integral spout 60 extending upwardly from shoulder 62 along one side of container 58, with the spout and shoulder being heat sealed as above. However, an integral gripping means is provided by upper central and side region 64 remaining affixed to the container and being provided with opening 66 for a finger grip.

Figure 7:
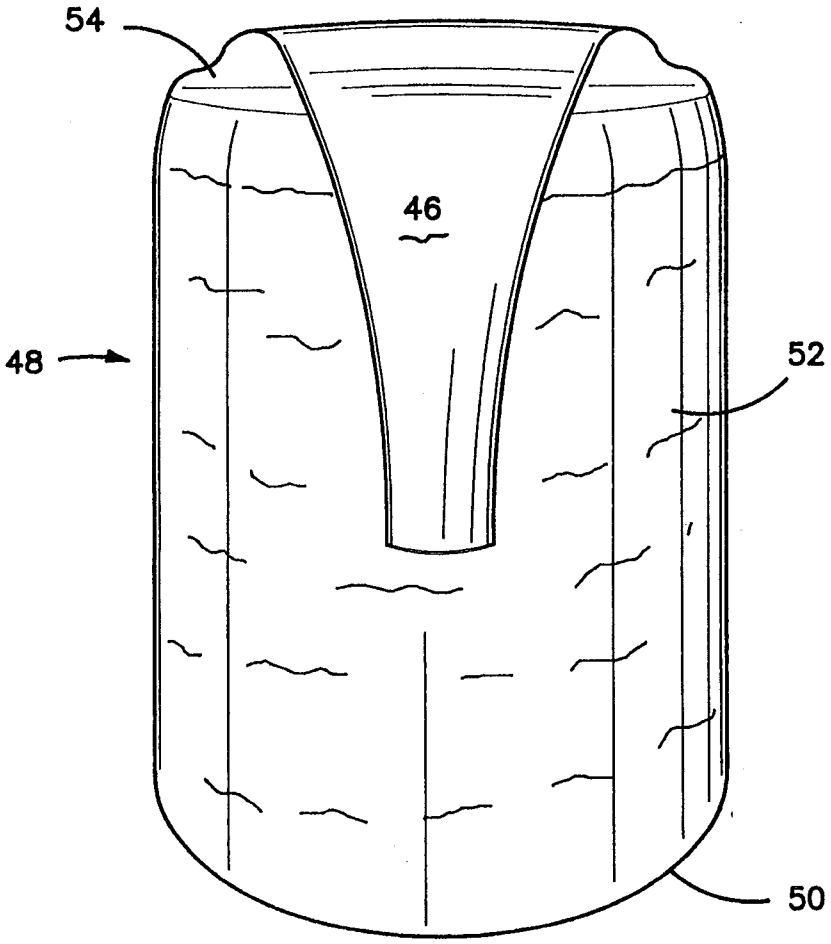
FIG. 7 is a perspective view of the final filled container of FIG. 5.

Spout 46 can be folded over and affixed to body portion 52 as by a peelable adhesive or a tab (not shown) on body portion 52, as shown in FIG. 7, for storage when not in use. The filled container can if desired be transported in a separate shipping container, as a carton. Also, as clearly shown in FIG. 7, the length of spout 46 is equal to at least one-half of the length of the body portion 52 from base 50 to shoulder 54.

Figure 8:
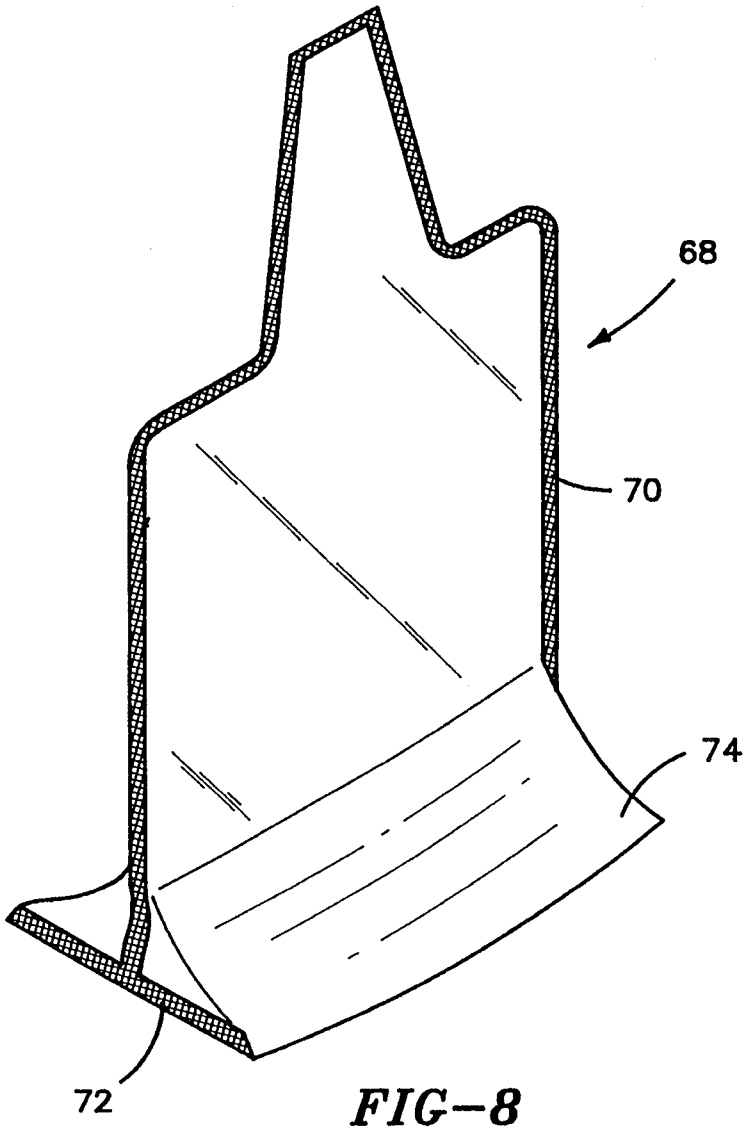
FIG. 8 is a perspective view of a variant container.

FIG. 8 shows a still further embodiment with bonded container blank 68 having side bonded regions 70 and end bonded regions 72 perpendicular thereto to form a self standing base 74.

Figure 10:
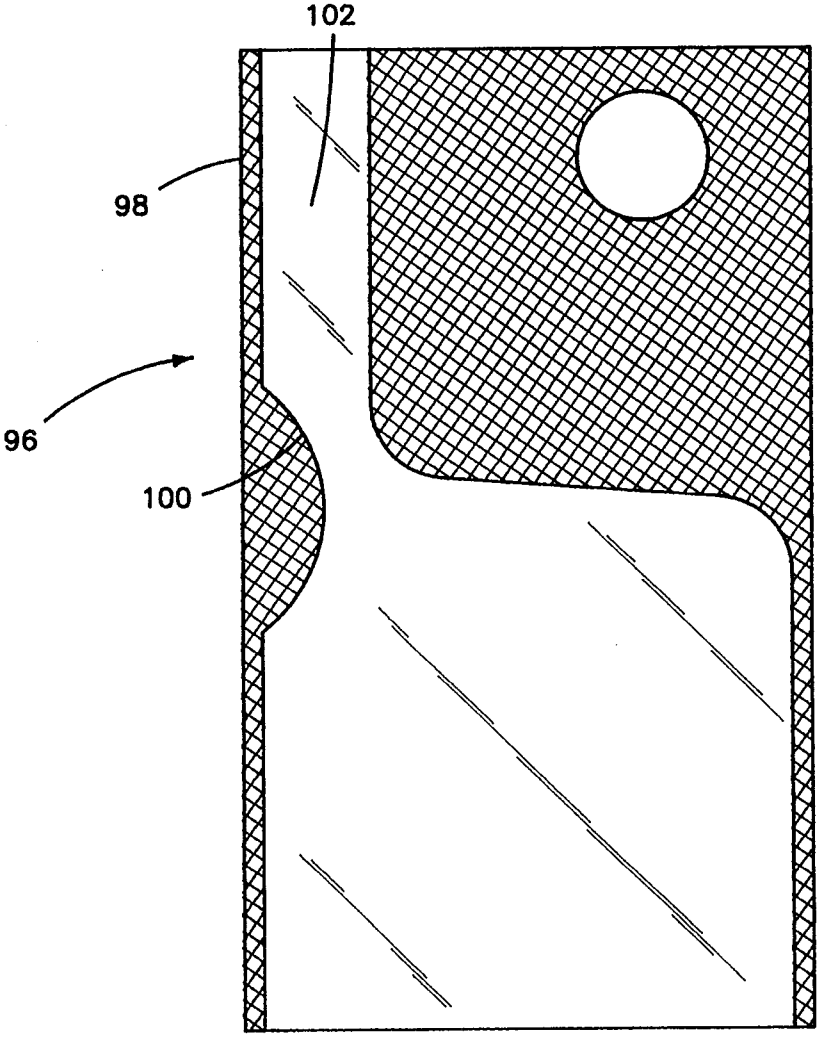
FIGS. 9 and 10 are further preferred embodiments.
Figure 9:
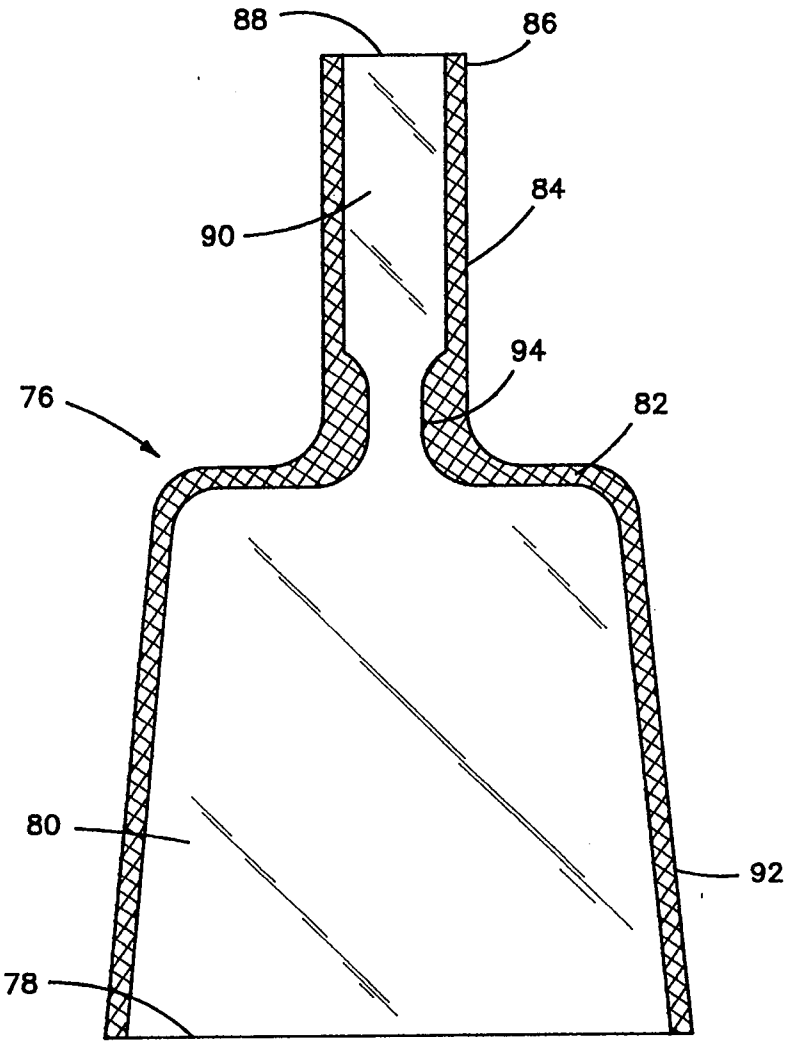

FIGS. 9 and 10 are top views showing variations of the embodiments of FIGS. 5 and 6, respectively, showing the bonded areas. Thus, blank 76 in FIG. 9 includes base portion 78, body portion 80 extending upwardly from the base, a shoulder portion 82 extending upwardly from the body portion, and an integral spout portion 84 extending upwardly from the shoulder. Spout portion 84 has an end portion 86, a given length which is less than the length of the body portion, an opening 88 in end portion 86, and an open channel 90 along the length thereof to provide access to the container. The blank includes bonded regions 92 as in previous embodiments, but desirably open channel 90 includes at least one constricted area 94 in open channel 90 which is formed from bonded regions 92. The final filled container may be formed as in other embodiments. This represents a particularly preferred embodiment. The constricted regions overcome the disadvantage of an increase in the velocity of the discharged liquid upon dispensing the contents. This increase in velocity represents a considerable disadvantage. In accordance with the embodiment of FIG. 9, however, one does not obtain such an increase in velocity, and indeed leakage in storage is also not obtained. Thus, the constricted area represents a pressure increase area and the larger area above the constriction in the open channel represents a pressure drop area. The outgoing liquid will exit the container with its pressure dropping instead of increasing. As a result, there is more control over the outflowing velocity. Characteristics can be designed for particular results by varying the size of the constriction and the spout portion.

FIG. 10 is similar to FIG. 9 based on the embodiment of FIG. 6, with blank 96 including a spout portion 98 with constricted area 100 in open channel 102 which serves the same purpose as in FIG. 9.

Thus, the container of the present invention may readily be used for any product requiring protection from contamination, spoilage and the like. Also, the present container adds the convenience of an integral straw with dispensing only by gravity or by pressing the soft walls of the container together to force the contents upwardly through the spout. The container does not require addition of a straw or valve for dispensing, and can be readily handled and shipped without leakage. Further, the container is recyclable and light weight, with up to 90% less weight than with known containers. When not in use, the gravity of the liquid pulls the walls of the spout together to prevent spillage and contamination. The constricted area in the spout portion provides a further and significant advantage.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container which comprises: a single, unitary piece of plastic folded and bonded together to form a container, said container having a base portion, a body portion extending upwardly from the base, a shoulder portion extending upwardly from the body portion, and an integral spout portion extending upwardly from the shoulder and forming an integral straw, bonded portions of said plastic extending upwardly from the base along the body portion, shoulder portion and spout portion, wherein the spout portion has an end portion, a length, an opening in the end portion and an open channel along the length thereof to provide access to the container, including at least one constricted area formed by bonded regions in said open channel to prevent increase in velocity upon dispensing the container contents, and wherein the spout portion includes a lower portion thereof adjacent the shoulder portion with the constricted area being located in the lower portion adjacent the shoulder, and wherein the length of the spout downstream of the constricted area is equal to at least about one-half the length of the body portion from the base to the shoulder.

2. A container according to claim 1 wherein the base is flat formed by bonded portions of the base to provide a self standing container when the container is filled.

3. A container according to claim 2 wherein the spout is folded over alongside of the body portion when the container is not in use.

4. A container according to claim 2 wherein the spout is located centrally of the container.

5. A container according to claim 2 wherein the spout is located along one side of the container.

6. A container according to claim 2 including an integral gripping means affixed to the container.

7. A container according to claim 6 wherein said gripping means includes an integral sheet extending from said spout with at least one opening therein.

8. A container according to claim 2 including bonded portions of the base perpendicular to bonded portions of said body.

9. A container according to claim 2 including bonded portions of said base comprising at least two folds, each bonded together.

* * * * *